US007051621B1

(12) United States Patent
Halpin

(10) Patent No.: US 7,051,621 B1
(45) Date of Patent: May 30, 2006

(54) GRIPPING DEVICE

(76) Inventor: Hal Woodrow Halpin, 4248 W. Camino Vivaz, Glendale, AZ (US) 85310

( * ) Notice: Subject to any disclaimer, the term of this patent is extended or adjusted under 35 U.S.C. 154(b) by 0 days.

(21) Appl. No.: 10/831,912

(22) Filed: Apr. 26, 2004

Related U.S. Application Data

(60) Provisional application No. 60/465,706, filed on Apr. 26, 2003.

(51) Int. Cl.
*B67B 7/18* (2006.01)

(52) U.S. Cl. ..... 81/3.44; 294/99.2

(58) Field of Classification Search ..... 81/3.44, 81/3.4, 64; 294/99.1, 99.2, 902
See application file for complete search history.

(56) References Cited

U.S. PATENT DOCUMENTS 1,469,427 A * 10/1923 Mittan ..... 81/3.44
1,504,964 A * 8/1924 Newland ..... 81/90.8
3,259,415 A * 7/1966 Howard ..... 294/99.2
3,815,607 A * 6/1974 Chester ..... 294/99.2

* cited by examiner

*Primary Examiner*—Debra S Meislin
(74) *Attorney, Agent, or Firm*—Parsons & Goltry; Michael W. Goltry; Robert A. Parsons

(57) ABSTRACT

A device for gripping twist caps includes a) opposing substantially coextensive coactive first and second handles having hingedly attached proximal extremities, and opposing distal extremities, respectively, b) opposed confronting first and second inwardly-directed faces carried by the first and second handles, respectively, c) longitudinal, substantially parallel rows of teeth carried by the first handle projecting away from the first inwardly-directed face, and d) longitudinal, substantially parallel rows of teeth carried by the second handle and projecting away from the second inwardly-directed face.

13 Claims, 2 Drawing Sheets

GRIPPING DEVICE

CROSS-REFERENCE TO RELATED APPLICATION

This application claims the benefit of U.S. Provisional Patent Application Ser. No. 60/465,706, filed 26 Apr. 2003.

FIELD OF THE INVENTION

This invention relates to gripping devices specifically adapted and arranged for gripping and securing twist-on caps and lids.

BACKGROUND OF THE INVENTION

Glass and plastic bottles and containers for food, beverages, and other materials are now commonplace throughout the world. Virtually all such containers are sealed with twist-on/twist-off caps and lids, which can be easily removed for accessing the contents of the containers, and subsequently reattached as needed. Twist- on/twist-off caps and lids constitute an inexpensive and efficient means of sealing bottles and other containers. However, they can be difficult to remove and difficult to reinstall, especially for the elderly and others having limited or impaired hand strength. Although skilled artisans have devoted considerable effort toward devices that are adapted and arranged to help grip twist-on/twist- off caps and lids for aiding users in removing and reattaching such caps and lids, existing devices are difficult to construct, expensive, and cumbersome to use. Given these and other deficiencies in the art, the need for continued improvement is evident.

SUMMARY OF THE INVENTION

A preferred embodiment of a device for gripping twist caps includes a) opposing substantially coextensive coactive first and second handles having hingedly attached proximal extremities, and opposing distal extremities, respectively, b) opposed confronting first and second inwardly-directed faces carried by the first and second handles, respectively, c) longitudinal, substantially parallel rows of teeth carried by the first handle projecting away from the first inwardly-directed face, and d) longitudinal, substantially parallel rows of teeth carried by the second handle and projecting away from the second inwardly-directed face. A spring hinge hingedly couples the proximal extremity of the first handle to the proximal extremity of the second handle. In a particular embodiment, the longitudinal, substantially parallel rows of teeth carried by the first handle projecting away from the first inwardly-directed face include longitudinal, substantially parallel first and second rows of teeth, and the longitudinal, substantially parallel rows of teeth carried by the second handle and projecting away from the second inwardly-directed face include longitudinal, substantially parallel first and second rows of teeth. The teeth of the first row of teeth carried by the first handle are directed toward the proximal extremity thereof, the teeth of the second row of teeth carried by the first handle are directed toward the distal extremity thereof, the teeth of the first row of teeth carried by the second handle are directed toward the proximal extremity thereof, and the teeth of the second row of teeth carried by the second handle are directed toward the distal extremity thereof. In another embodiment, the teeth of the first row of teeth carried by the first handle are directed toward the proximal extremity thereof, the teeth of the second row of teeth carried by the first handle are directed toward the proximal extremity thereof, the teeth of the first row of teeth carried by the second handle are directed toward the distal extremity thereof, and the teeth of the second row of teeth carried by the second handle are directed toward the distal extremity thereof. Preferably, the first rows of teeth of the first and second handles, respectively, reside in a substantially common first plane, and the second rows of teeth of the first and second handles, respectively, reside in a substantially common second plane, in which the first and second planes are spaced apart and substantially parallel relative to one another. The spring hinge and the first and second handles consist of an integral body formed from a substantially flexible material having shape memory. The spring hinge consists of a generally U-shaped body having extremities coupled to the proximal extremities of the first and second handles, respectively.

Another preferred embodiment of a device for gripping twist caps includes a) a body comprising a spring hinge, opposing substantially coextensive coactive first and second handles having proximal extremities, and opposing distal extremities, respectively, b) opposed confronting first and second inwardly-directed faces carried by the first and second handles, respectively, c) longitudinal, substantially parallel first and second rows of teeth carried by the first handle projecting away from the first inwardly-directed face, d) longitudinal, substantially parallel first and second rows of teeth carried by the second handle and projecting away from the second inwardly- directed face, e) wherein the teeth of the first row of teeth carried by the first handle are directed toward the proximal extremity thereof, and the teeth of the second row of teeth carried by the first handle are directed toward the distal extremity thereof, and f) wherein the teeth of the first row of teeth carried by the second handle are directed toward the proximal extremity thereof, and the teeth of the second row of teeth carried by the second handle are directed toward the distal extremity thereof. In an alternate embodiment, the teeth of the first row of teeth carried by the first handle are directed toward the proximal extremity thereof, the teeth of the second row of teeth carried by the first handle are directed toward the proximal extremity thereof, the teeth of the first row of teeth carried by the second handle are directed toward the distal extremity thereof, and the teeth of the second row of teeth carried by the second handle are directed toward the distal extremity thereof. A spring hinge hingedly couples the proximal extremity of the first handle to the proximal extremity of the second handle. Preferably, the first rows of teeth of the first and second handles, respectively, reside in a substantially common first plane, and the second rows of teeth of the first and second handles, respectively, reside in a substantially common second plane, in which the first and second planes are spaced apart and substantially parallel relative to one another. The spring hinge and the first and second handles consist of an integral body formed from a substantially flexible material having shape memory. The spring hinge consists of a generally U-shaped body having extremities coupled to the proximal extremities of the first and second handles, respectively.

Yet another preferred embodiment of a device for gripping twist caps includes a) opposing substantially coextensive coactive first and second handles having proximal extremities, and opposing distal extremities, respectively, b) a spring hinge hingedly coupling the proximal extremity of the first handle to the proximal extremity of the second handle, c) the spring hinge and the first and second handles comprising an integral body formed from a substantially flexible material having shape memory, d) opposed confronting first and second inwardly-directed faces carried by the first and second handles, respectively, e) longitudinal, substantially parallel first and second rows of teeth carried by the first handle projecting away from the first inwardly-directed face, and f) longitudinal, substantially parallel first and second rows of teeth carried by the second handle and projecting away from the second inwardly-directed face. The teeth of the first row of teeth carried by the first handle are directed toward the proximal extremity thereof, the teeth of the second row of teeth carried by the first handle are directed toward the distal extremity thereof, the teeth of the first row of teeth carried by the second handle are directed toward the proximal extremity thereof, and the teeth of the second row of teeth carried by the second handle are directed toward the distal extremity thereof. In an alternate embodiment, the teeth of the first row of teeth carried by the first handle are directed toward the proximal extremity thereof, the teeth of the second row of teeth carried by the first handle are directed toward the proximal extremity thereof, the teeth of the first row of teeth carried by the second handle are directed toward the distal extremity thereof, and the teeth of the second row of teeth carried by the second handle are directed toward the distal extremity thereof. Preferably, the first rows of teeth of the first and second handles, respectively, reside in a substantially common first plane, and the second rows of teeth of the first and second handles, respectively, reside in a substantially common second plane, in which the first and second planes are spaced apart and substantially parallel relative to one another. The spring hinge consists of a generally U-shaped body having extremities coupled to the proximal extremities of the first and second handles, respectively.

Consistent with the foregoing summary of preferred embodiments of the invention, and the ensuing disclosure, which are to be taken together, the invention also contemplates associated embodiments.

BRIEF DESCRIPTION OF THE DRAWINGS

Referring to the drawings.

DETAILED DESCRIPTION OF A PREFERRED EMBODIMENT

Figures 1, 2, 3, 4:
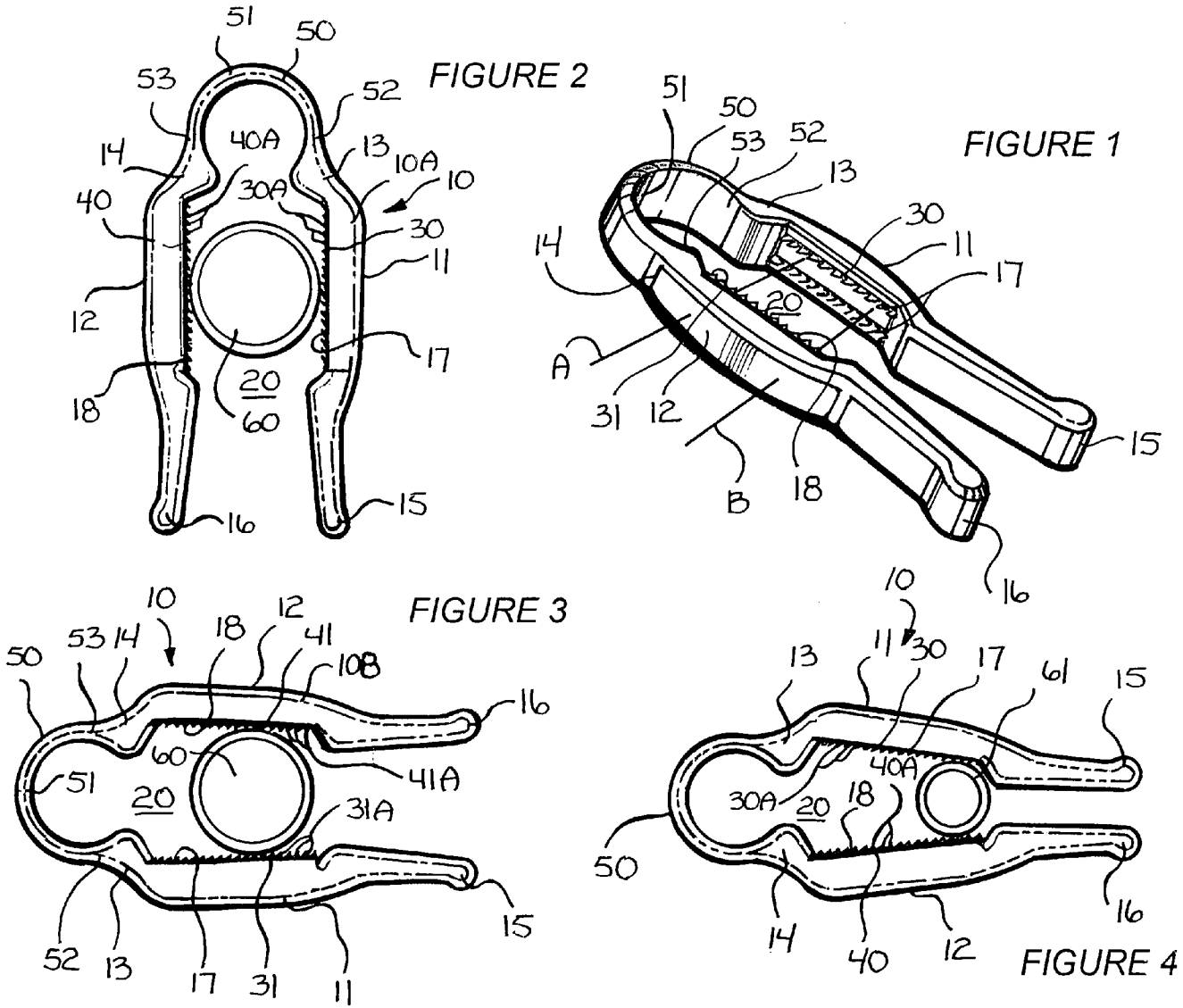
FIG. 1 is a perspective view of a gripping device constructed and arranged in accordance with the principle of the invention.
FIG. 2 is a top plan view of the gripping device of FIG. 1 with a cap disposed between handles of the gripping device.
FIG. 3 is a bottom plan view of the gripping device of FIG. 1 with a cap disposed between handles of the gripping device.
FIG. 4 is a top plan view of the gripping device of FIG. 1 with a cap disposed between handles of the gripping device.

Turning now to the drawings, in which like reference characters indicate corresponding elements throughout the several views, attention is first directed to FIG. 1, in which there is seen a device 10 for gripping twist caps/lids (the terms "cap" and "lid" are intended to be used interchangeably), which includes opposing substantially coextensive coactive handles 11 and 12 having hingedly attached proximal extremities 13 and 14, opposing distal extremities 15 and 16, and opposing confronting inwardly-directed faces 17 and 18 carried by first and second handles 11 and 12, respectively. Proximal extremities 13 and 14 define the forward end of device 10, and distal extremities 15 and 16 define the rearward end of device 10. Face 17 is positioned between proximal and distal extremities 13 and 15 of handle 11, and face 18 is positioned between proximal and distal extremities 14 and 16 of handle 12. As a matter of orientation, device 10 has an upper side 10A (FIG. 2) and a lower side 10B (FIG. 3), and faces 17 and 18 face, and help define, a gap 20 between handles 11 and 12. Referring also to FIGS. 2 and 3, which illustrate top and bottom plan views of device 10, respectively, longitudinal, substantially parallel rows 30 and 31 of teeth 30A and 31A, respectively, are carried by handle 11, which are located at face 17 and project into gap 20 away from face 17. As seen in FIGS. 2 and 3, longitudinal, substantially parallel rows 40 and 41 of teeth 40A and 41A, respectively, are carried by handle 12, which are located at face 18 and project into gap 20 away from face 18. Row 30 of teeth 30A, row 31 of teeth 31A, row 40 of teeth 40A, and row 41 of teeth 41A, each constitute toothed metal strips, which are embedded in place, glued in place, and they may be fixed in place in other ways as may be desired.

As seen in FIG. 2, teeth 30A of row 30 are directed forwardly toward proximal extremity 13, and teeth 40A of row 40 are directed rearwardly toward distal extremity 16. As seen in FIG. 3, teeth 31A of row 31 are directed rearwardly toward distal extremity 15, and teeth 41A of row 41 are directed forwardly toward proximal extremity 14. If desired, this arrangement can be reversed, in which teeth 30A of row 30 are directed rearwardly toward distal extremity 15, teeth 40A of row 40 are directed forwardly toward proximal extremity 14, teeth 31A of row 31 are directed forwardly toward proximal extremity 13, and teeth 41A of row 41 are directed rearwardly toward distal extremity 16.

Preferably, rows 30 and 40 of teeth 30A and 40A, respectively, reside in a substantially common plane denoted at A in FIG. 1, and rows 31 and 41 of teeth 31A and 41A, respectively, reside in a substantially common plane denoted at B in FIG. 1, in which these described planes A and B are spaced apart and substantially parallel relative to one another. It is to be understood that teeth 30A and teeth 40A are pointed in opposite directions, as are teeth 31A and 41A. Also, although device incorporates two pairs of opposing rows of teeth as herein described, more than two opposing pairs of rows of teeth can be used consistent with this disclosure, if desired.

As seen in FIGS. 1–3, device 10 incorporates a spring hinge 50, which hingedly couples proximal extremity 13 of handle 11 to proximal extremity 15 of handle 12. Spring hinge 50 not only couples handle 11 to handle 12, but also maintains handles 11 and 12 in an opposing, spaced-apart relation as in FIG. 1, which defines an open position of device 10, and yet it can be overcome so as to permit handles 11 and 12 to be forced together, defining a closed position of device 10, through application of an inwardly compressive force applied to handles 11 and 12 for clamping and gripping a twist cap/lid 60 disposed therebetween rows 30 and 31 of teeth 30A and 31A and rows 40 and 41 of teeth 40A and 41A as seen in FIGS. 2 and 3, respectively. When an applied force forcibly moving handles 11 and 12 toward one so as to grip and clamp a cap/lid is removed, spring hinge 50 moves handles 11 and 12 back to their original positions away from one another, i.e., the open position of device 10.

Spring hinge 50 consists of a generally U-shaped body 51 having shape memory and opposing extremities 52 and 53 coupled to proximal extremities 13 and 14 of handles 11 and 12, respectively. Preferably, spring hinge 50 and handles 11 and 12 consist of an integral body formed from a substantially flexible material having shape memory, such as plastic, spring steel, or the like.

To remove twist cap 60 from a bottle or container, device 10 is taken up by hand and maneuvered so as to position cap between rows 30,31 and rows 40,41, in which handles 11 and 12 are then forced together so as to clamp cap 60 therebetween. In securing cap 60 in this manner, teeth 30A,31A,40A,41A impinge against, or otherwise grip, the outer surface of cap 60. To remove or loosen cap 60, device 10 is rotated counterclockwise, in which teeth 30A,40A grip secure cap 60 due to the opposing directions in which teeth 30A,40A project as previously disclosed ensuring a competent hold against cap 60. To reattach or tighten cap 60, device 10 is rotated clockwise, in which teeth 31A,410A grip secure cap 60 due to the opposing directions teeth 31A,41A project as previously disclosed ensuring a competent hold against cap 60.

It is to be understood that device 10 can be used for removing and reattaching twist caps of varying size. As a matter of illustration of this aspect, FIGS. 2 and 3 shown device 10 as it would appear in use in conjunction with twist cap 60, and FIG. 4 shows device 10 as it would appear in use in conjunction with twist cap 61, in which twist cap 61 is smaller than twist cap 60. When device 10 is fully closed, as shown substantially in FIG. 4, pair of rows 30,31 and pair of rows 40,41 are angularly disposed relative to each other and converge toward the rearward end of device 10, and this aspect of device 10 permits it to be easily employed with twist caps of varying size.

Figure 6:
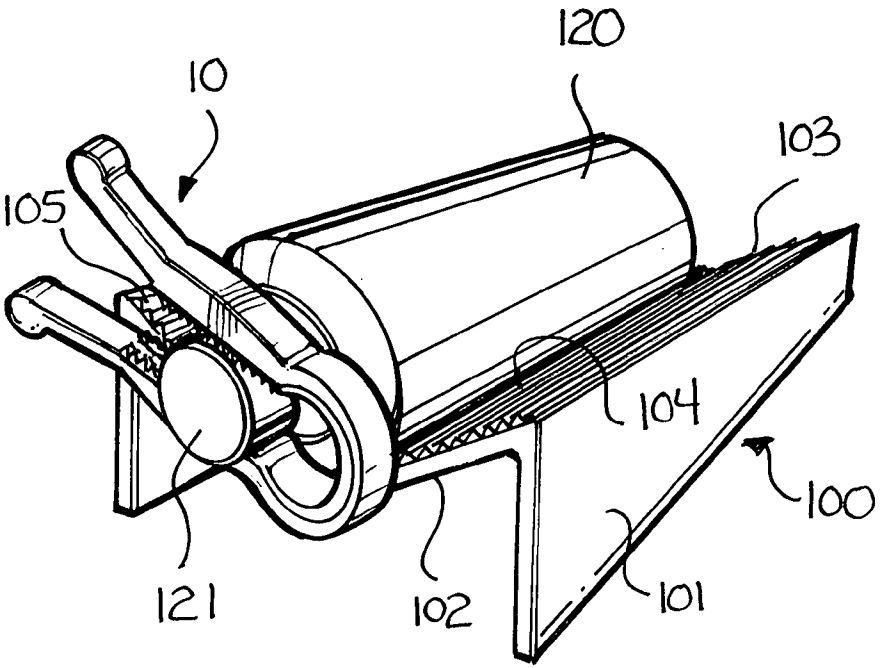
FIG. 6 is a perspective view of a container held by the container holder of FIG. 5 with the gripping device of FIG. 1 shown as it would appear gripping a cap attached to the container.
Figure 5:
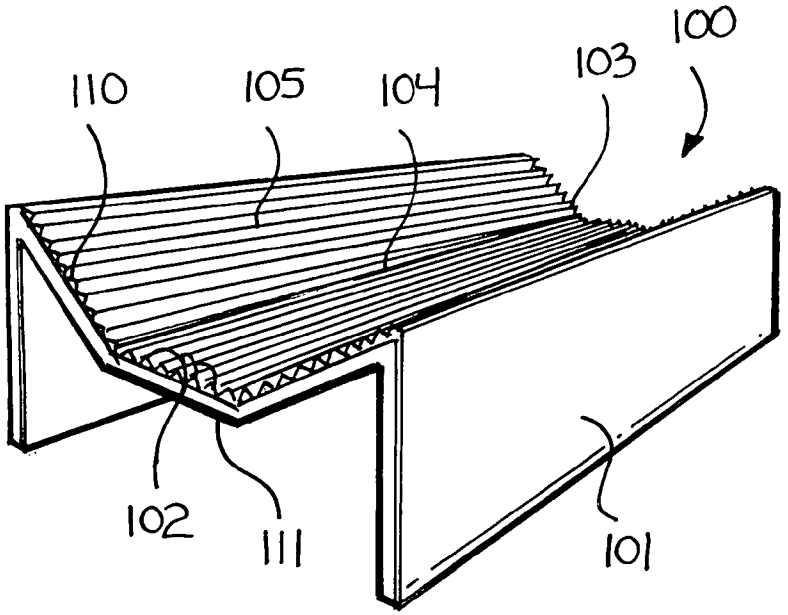
FIG. 5 is a perspective view of a container holder constructed and arranged in accordance with the principle of the invention.

Referring to FIG. 5, there is seen is a perspective view of a container holder 100, which consists of a framework 101 having a forward end 102, a rearward end 103, and a generally U-shaped seat 104, which slopes downwardly from forward end 102 to rearward end 103 and is lined with a gripper lining 105, which is fashioned of rubber, a rubber-like material, foam, or the like. Framework 101 is fashioned of plastic, wood, metal, or other substantially rigid material or combination of materials. Lining 105 is applied and secured in place, such as with adhesive, staples, rivets, etc. A transverse row 110 of teeth 111 is secured, such as by way of embedding or with a suitable adhesive or the like, at forward end 102. Row 110 of teeth 111 consists of one or more lengths of toothed metal strips. To employ holder 100 in conjunction with device 10 as shown in FIG. 6, holder 100 is placed onto a support surface, such as a counter or table, so as to direct seat 104 upwardly, and a container 120, having an attached twist cap 121, is placed into seat 103, so as to position cap 121 outboard of forward end 102 thus disposing cap at an elevated location relative to the support surface upon which holder 100 is placed. By holding bottle 120 against seat 104, teeth 111 impinge against bottle 120, in which teeth 111 and lining 105 cooperate to prevent bottle 120 from rotating relative to seat 104. With bottle 120 so held and secured, device 10 can be taken up by hand and applied to cap 121, as generally shown, and used as previously described for not only removing/loosening cap 121 but also reattaching/tightening cap 121, in which bottle 120 is prevented from rotating and is otherwise held fast while cap 121 is acted upon with the use of device 10. It is to be understood that teeth 111 can be located at other positions so as to interact with a bottle placed into seat 104.

The invention has been described above with reference to a preferred embodiment. However, those skilled in the art will recognize that changes and modifications may be made to the embodiment without departing from the nature and scope of the invention. For instance, in an alternate embodiment, teeth 30A of row 30 are directed forwardly toward proximal extremity 13, teeth 31A of row 31 are directed forwardly toward proximal extremity 13, teeth 40A of row 40 are directed rearwardly toward distal extremity 16, and teeth 41A of row 41 are directed rearwardly toward distal extremity 16. To use this embodiment of a device constructed in accordance with the principle of the invention, it is to be to used with upper side 10A facing up for opening/loosening a twist cap, and with lower side 10B facing up for closing/tightening a twist cap. In yet another embodiment, teeth 30A of row 30 are directed rearwardly toward distal extremity 15, teeth 31A of row 31 are directed rearwardly toward distal extremity 15, teeth 40A of row 40 are directed forwardly toward proximal extremity 14, and teeth 41A of row 41 are directed forwardly toward proximal extremity 14. To use this embodiment of a device constructed in accordance with the principle of the invention, it is to be used with lower side 10B facing up for opening/loosening a twist cap, and with upper side 10A facing up for closing/tightening a twist cap.

Further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

What is claimed is:

1. A device for gripping twist caps comprising:

opposing substantially coextensive coactive first and second handles having hingedly attached proximal extremities, and opposing distal extremities, respectively;

opposed confronting first and second inwardly-directed faces carried by the first and second handles, respectively;

longitudinal, substantially parallel first and second rows of teeth carried by the first handle projecting away from the first inwardly-directed face;

longitudinal, substantially parallel first and second rows of teeth carried by the second handle and projecting away from the second inwardly-directed face;

wherein the teeth of the first row of teeth carried by the first handle are directed toward the proximal extremity thereof, and the teeth of the second row of teeth carried by the first handle are directed toward the distal extremity thereof; and wherein the teeth of the first row of teeth carried by the second handle are directed toward the proximal extremity thereof, and the teeth of the second row of teeth carried by the second handle are directed toward the distal extremity thereof.

2. The device of claim 1, further comprising a spring hinge hingedly coupling the proximal extremity of the first handle to the proximal extremity of the second handle.

3. The device of claim 1, wherein the first rows of teeth of the first and second handles, respectively, reside in a substantially common first plane.

4. The device of claim 3, wherein the second rows of teeth of the first and second handles, respectively, reside in a substantially common second plane, which is spaced apart from, and substantially parallel to, the first plane.

5. The device of claim 2, wherein the spring hinge and the first and second handles comprising an integral body formed from a substantially flexible material having shape memory.

6. A device for gripping twist caps comprising:

a body comprising a spring hinge, opposing substantially coextensive coactive first and second handles having proximal extremities, and opposing distal extremities, respectively;

opposed confronting first and second inwardly- directed faces carried by the first and second handles, respectively;

longitudinal, substantially parallel first and second rows of teeth carried by the first handle projecting away from the first inwardly-directed face;

longitudinal, substantially parallel first and second rows of teeth carried by the second handle and projecting away from the second inwardly-directed face;

wherein the teeth of the first row of teeth carried by the first handle are directed toward the proximal extremity thereof, and the teeth of the second row of teeth carried by the first handle are directed toward the distal extremity thereof; and wherein the teeth of the first row of teeth carried by the second handle are directed toward the proximal extremity thereof, and the teeth of the second row of teeth carried by the second handle are directed toward the distal extremity thereof.

7. The device of claim 6, wherein the first rows of teeth of the first and second handles, respectively, reside in a substantially common plane.

8. The device of claim 7, wherein the second rows of teeth of the first and second handles, respectively, reside in a substantially common plane.

9. The device of claim 6, wherein the spring hinge and the first and second handles comprising an integral body formed from a substantially flexible material having shape memory.

10. A device for gripping twist caps comprising:

opposing substantially coextensive coactive first and second handles having proximal extremities, and opposing distal extremities, respectively;

a spring hinge hingedly coupling the proximal extremity of the first handle to the proximal extremity of the second handle;

the spring hinge and the first and second handles comprising an integral body formed from a substantially flexible material having shape memory;

opposed confronting first and second inwardly- directed faces carried by the first and second handles, respectively;

longitudinal, substantially parallel first and second rows of teeth carried by the first handle projecting away from the first inwardly-directed face;

longitudinal, substantially parallel first and second rows of teeth carried by the second handle and projecting away from the second inwardly-directed face;

wherein the teeth of the first row of teeth carried by the first handle are directed toward the proximal extremity thereof, and the teeth of the second row of teeth carried by the first handle are directed toward the distal extremity thereof; and wherein the teeth of the first row of teeth carried by the second handle are directed toward the proximal extremity thereof, and the teeth of the second row of teeth carried by the second handle are directed toward the distal extremity thereof.

11. The device of claim 10, wherein the first rows of teeth of the first and second handles, respectively, reside in a substantially common first plane.

12. The device of claim 11, wherein the second rows of teeth of the first and second handles, respectively, reside in a substantially common second plane.

13. The device of claim 12, wherein the first and second planes are spaced apart and substantially parallel relative to one another.

* * * * *